United States Patent [19]

Saunders et al.

[11] Patent Number: 4,848,623

[45] Date of Patent: Jul. 18, 1989

[54] DISC REMOVAL END WALL STRUCTURE WITH SAFETY FEATURES

[75] Inventors: William T. Saunders, Weirton, W. Va.; James A. Bray, Salineville, Ohio

[73] Assignee: Weirton Steel Corporation, Weirton, W. Va.

[21] Appl. No.: 232,837

[22] PCT Filed: Jan. 23, 1987

[86] PCT No.: PCT/US87/00102

§ 371 Date: Jun. 27, 1988

§ 102(e) Date: Jun. 27, 1988

[87] PCT Pub. No.: WO88/05405

PCT Pub. Date: Jul. 28, 1988

[51] Int. Cl.[4] ..... B65D 17/34; B65D 17/40; B21D 51/44; B21D 51/28

[52] U.S. Cl. ..... 220/273; 220/276; 413/12; 413/14; 413/17

[58] Field of Search ..... 220/269, 270, 271, 272, 220/273, 276; 413/12, 14, 17, 67, 68

[56] References Cited

U.S. PATENT DOCUMENTS

| | | | |
|---|---|---|---|
| 3,684,126 | 8/1972 | Reichert | 220/273 |
| 3,696,961 | 10/1972 | Holk, Jr. | 220/269 |
| 3,838,788 | 10/1974 | Stargell | 220/276 X |
| 3,874,553 | 4/1975 | Schultz et al. | 220/273 |
| 3,941,277 | 3/1976 | McKinney et al. | 220/273 |
| 4,014,455 | 3/1977 | LaCroce | 220/269 |
| 4,019,648 | 4/1977 | Khoury | 220/273 |
| 4,159,061 | 6/1979 | Cornelius et al. | 220/276 X |
| 4,289,250 | 9/1981 | Jordan | 220/269 |
| 4,386,713 | 6/1983 | Baumeyer et al. | 220/269 |
| 4,406,378 | 9/1983 | Zysset | 220/273 |
| 4,511,299 | 4/1985 | Zysset | 413/12 |

*Primary Examiner*—Stephen Marcus
*Assistant Examiner*—Nora S. Tucker
*Attorney, Agent, or Firm*—Shanley and Baker

[57] ABSTRACT

A full-open, disc-removal, end wall structure (25) with improved easy-open lever action and edge-protection features is disclosed along with methods of fabricating and opening. A back-scoreline (38, 52) is ruptured, by Class 2 lever action, upon lifting of a rigid (non-lanced) tap opener (28, 51, 63) as the working end (32) of the tab opener ruptures a portion of peripheral scoreline (33); continued movement of the tab opener in the direction (46) into contact with chime seam (47) provides for continued lever-action rupture of the peripheral scoreline by Class 1 lever action about the chime seam as a fulcrum. Multi-folds of sheet metal provide rounded edge metal (73, 78) shilding for residual scoreline metal; pre-folding of the metal is carried out while leaving access for scoring tooling (86, 88) to enable scoring on a single thickness of sheet metal; and so as to avoid premature damage to the residual scoreline metal upon final orientation. Rivet button (83) and riveting of the tab opener to the removable disc (30) are carried out in the metal folding sequence.

20 Claims, 5 Drawing Sheets

FIG. 1
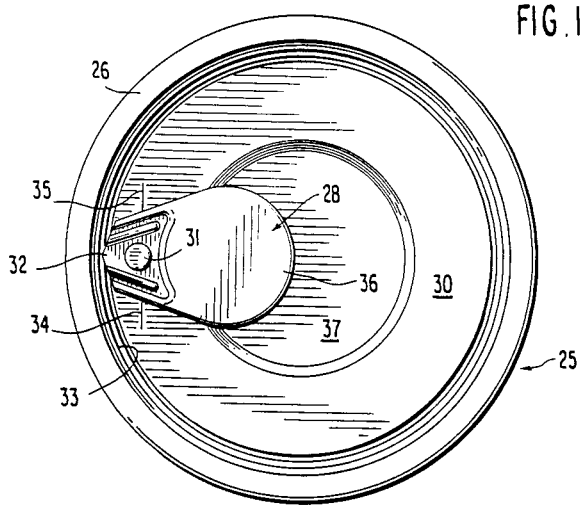
FIG. 2
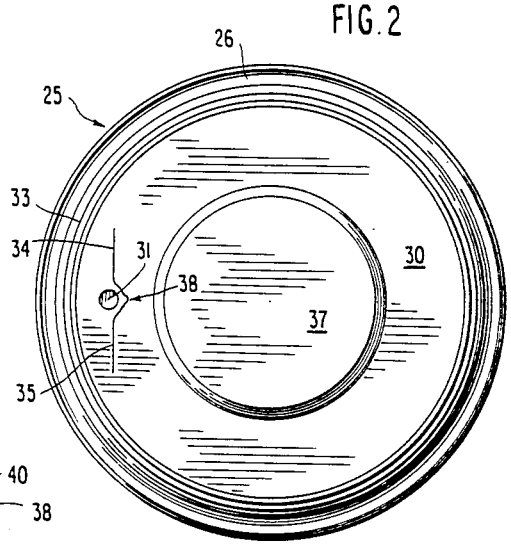
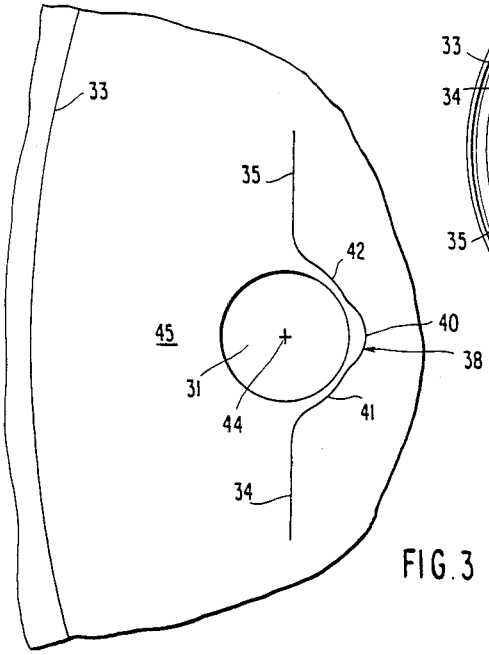
FIG. 3

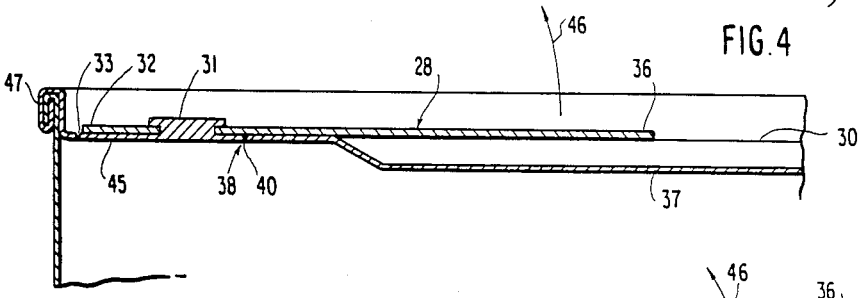
FIG. 4
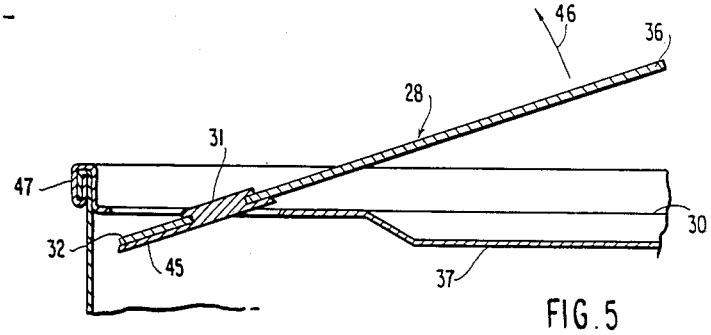
FIG. 5
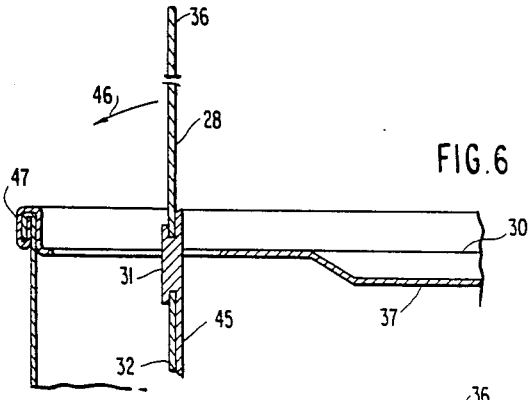
FIG. 6
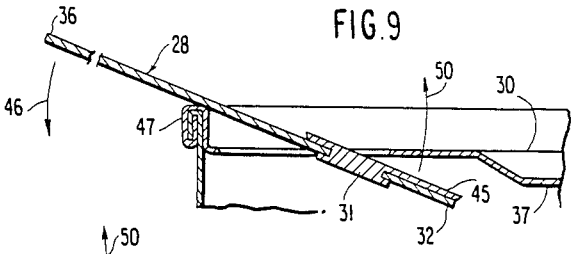
FIG. 9
FIG. 10
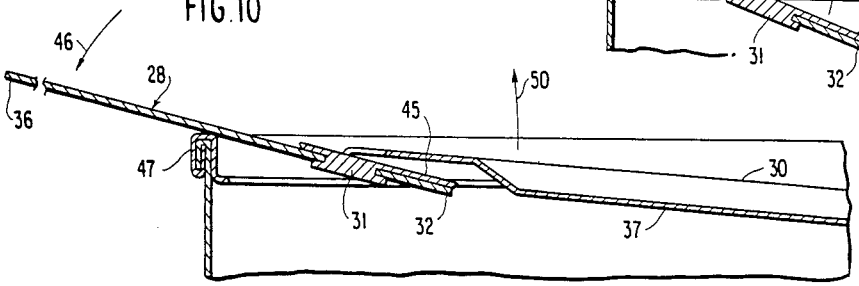

FIG. 7
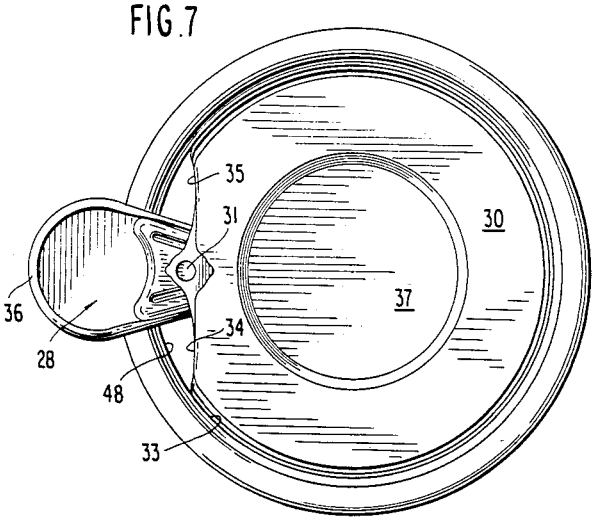
FIG. 13
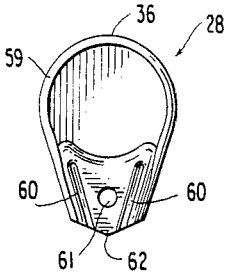
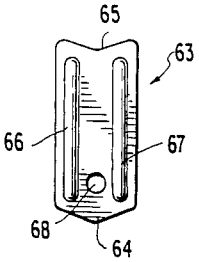
FIG. 14
FIG. 8
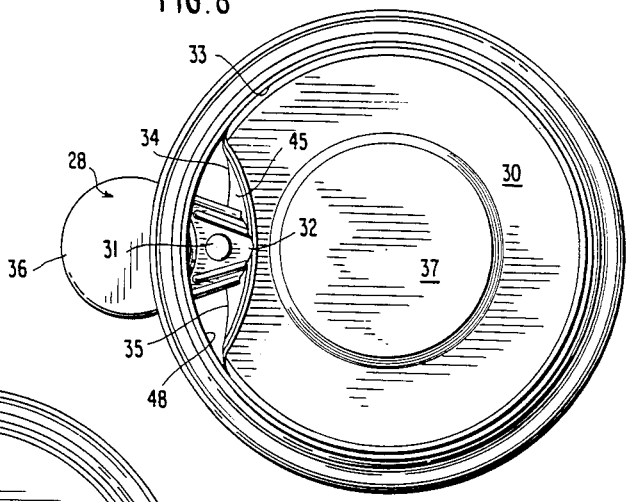
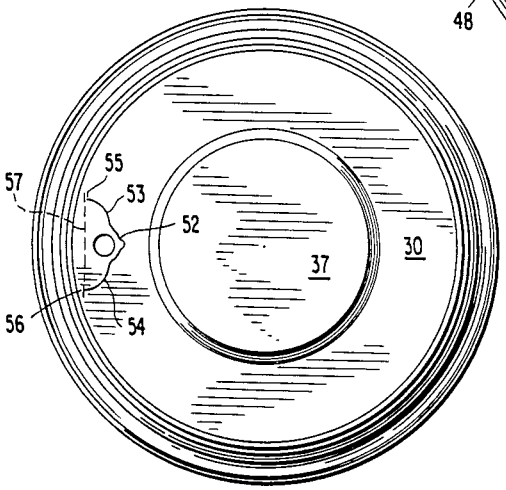
FIG. 11

FIG. 12
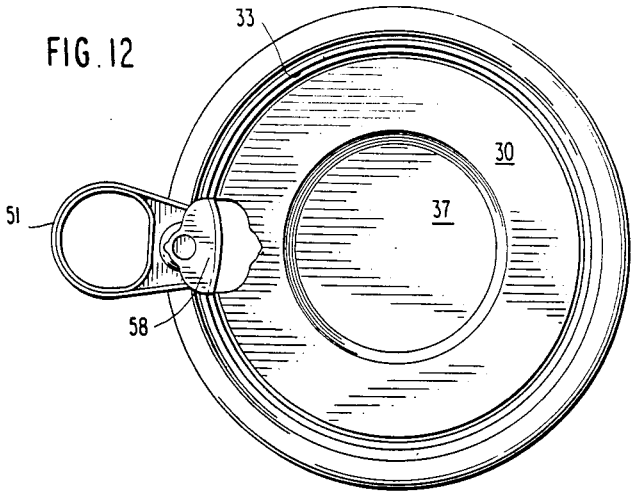
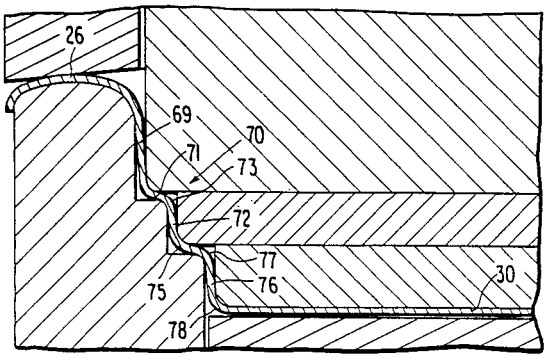
FIG. 15
FIG. 16
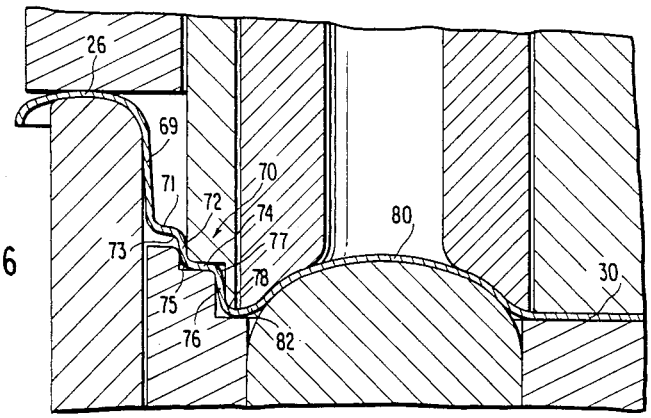

DISC REMOVAL END WALL STRUCTURE WITH SAFETY FEATURES

This invention relates to disc-removal, convenience-feature, sheet metal end-closure structures, to methods for fabricating and opening such structures, and to safety provisions for obstructing access to raw edge metal after opening such a closure structure.

In prior convenience-feature full-open sheet metal end closures of the disc pull-out type, after initial rupture of a portion of a peripherally-located scoreline by lifting on the handle end of a tab opener, it was necessary to pull backwardly on an open-ring of the pull-tab opener to continue severance of the remainder of the peripheral scoreline.

Past efforts to facilitate removal of end panel discs by such "pulling-out" methods included special scoreline and disc shapes (e.g. U.S. Pat. No. 3,768,392 of Oct. 30, 1973), and panel profiling techniques (e.g. U.S. Pat. No. 3,655,091 of Apr. 11, 1972 and U.S. Pat. No. 3,724,709 of Apr. 3, 1973). Also, tab openers for prior art disc pull-out structures were lanced to make initial lifting of the handle end easier (e.g. U.S. Pat. No. 4,182,460 of Jan. 8, 1980).

In such prior end closure structures, rupture of only a minor portion of the peripheral scoreline was aided by lever action of the tab opener. Pulling backwardly on the tab opener ring had to be relied on to continue severance of residual metal along the remaining major portion (about 90%) of the peripheral scoreline after such initial lever action rupture. More specifically, severance of such major portion of the peripheral scoreline had to be carried out without the assistance of any lever action mechanical advantage.

The difficulties in full-panel opening of an end wall structure resulting from such shortcomings of the prior art are overcome by contributions of the present invention.

In addition, the invention provides measures to help prevent accidental injury to a user due to the raw edge metal remaining after severing along the disc-defining peripheral scoreline. Such safety measures usually increase the difficulties experienced by most users in attempting to pull out an end wall panel. For example, shielding the raw edge of residual scoreline metal with multi-layer metal folds, as disclosed herein, can significantly increase stiffness of the removable end wall panel so that the force required to pull out a full-open disc using the prior art methods would be significantly increased.

The present invention facilitates removal of a full-open disc by providing for lever action throughout a major portion of the severance of the peripheral scoreline metal.

An integral, non-lanced tab-opener structure enables increased lever action. Further, a solid configuration hand end, free of any finger opening can be used to facilitate carrying out such lever action features and, as described in relation to later figures, to help avoid pulling backwardly on the handle end from a locatiom which lies internally of a longitudinal projection of the can side wall.

Other important contributions of the invention relate to new structures and methods for shielding the raw edge of residual scoreline metal after opening. Previously proposed safety-edge measures (e.g. U.S. Pat. No. 3,334,775 of Aug. 8, 1967 and U.S. Pat. No. 3,986,632 of Oct. 19, 1976) did not take into account the likelihood of premature damage to scoreline residual metal if significant movement of the metal adjacent to the scoreline was required subsequent to scoring. Nor were the difficulties of scoring accurately to depth, as part of the metal-folding scoreline-formation operations, contemplated.

The present invention provides for multi-layer folded-metal shielding of severed scoreline metal without detriment to accurate depth scoring or premature damage to the residual metal remaining after scoring.

These and other advantages and contributions are considered in greater detail in describing embodiments of the invention shown in the accompanying drawings; in these drawings:

FIG. 1 is a top plan (outer surface) view of an end closure structure of the invention shown with tab opener in place for opening;

FIG. 2 is a bottom plan (inner surface) view showing the positional interrelationship of back scoreline means with rivet means for securing a tab opener to the panel to be removed from such closure structure;

FIG. 3 is an enlarged top plan partial view, without the tab opener in place, for purposes of describing the contributions of the back scoreline means of FIG. 2 and its placement;

FIG. 4 is a schematic cross-sectional partial view of an end closure structure of the invention with tab opener in position prior to initiating scoreline rupture;

FIG. 5 is a schematic cross-sectional partial view of the end closure structure of FIG. 4 subsequent to initiation of rupture of the back scoreline and the starter segment of the disc-defining peripheral scoreline;

FIG. 6 is a schematic partial view, sequential to that of FIG. 5, showing completion of rupture of such starter segment;

FIG. 7 is a top plan view after continuation of the arcuate movement of the tab opener of FIG. 6, showing such opener in contact with chime seam metal in a position to continue severance of the peripheral scoreline beyond such starter segment using the chime seam as the fulcrum for the subsequent lever action made available;

FIG. 8 is a bottom plan view of the end wall structure at the opening stage of FIG. 7 showing a bend-line interconnection between the tab opener and the end wall disc for continued severance of the remainder of the peripheral scoreline by lever action using the chime seam as a fulcrum;

FIG. 9 is a partial schematic view in cross-section of structure in accordance with the invention for describing the Class I lever action which continues severance of the peripheral scoreline using the chime seam as a fulcrum;

FIG. 10 is a schematic cross-sectional view, subsequent to FIG. 9, for showing the disc "push-out" function of the invention utilizing Class I lever action of the tab opener with the chime seam acting as the fulcrum in which the removable disc is moved externally away from the container by such lever action;

FIG. 11 is a bottom plan view for showing another back scoreline configuration and its placement which further increase the mechanical advantage available;

FIG. 12 is a top plan view of the end wall structure of FIG. 11 in an intermediate opening stage;

FIG. 13 is a bottom plan view of a non-lanced tab opener presenting a solid configuration, free of a ring-pull opening at its handle end;

Figure 18:
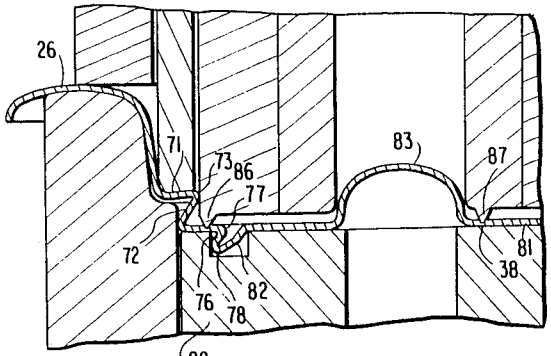
Figure 20:
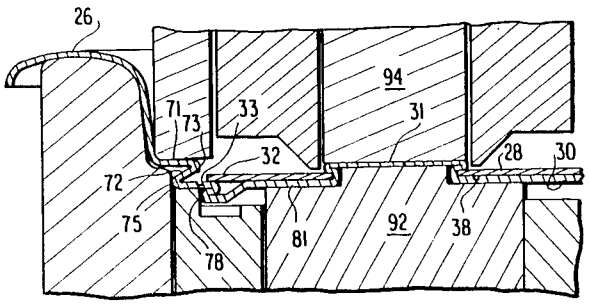
Figure 17:
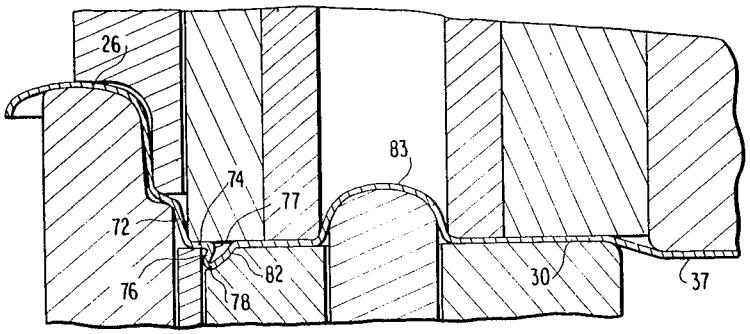
Figure 19:
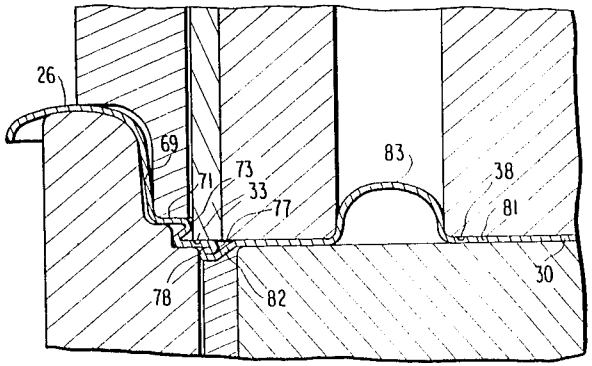

FIG. 14 is a top plan viw of another non-lanced tab-opener embodiment of the invention showing matching longitudinal end configurations which facilitate cutting such from continuous narrow-width metal strip, and FIGS. 15 through 20 are partial cross-sectional views for showing the results of and explaining sequential steps for coordinated formation of multi-layer sheet metal folds, scoring the sheet metal, forming a unitary rivet button, and riveting a tab opener to the removable disc, in which;

FIG. 15 shows the results of shaping a cut blank into chime seam metal, chuck wall, and intermediate fold metal portions extending in stepped fashion radially-inwardly and longitudinally-downward toward a recessed panel, FIG. 16 shows start of rivet button formation and an initial stage in the subsequent folding of such metal portions, FIG. 17 shows formation of a smaller diameter rivet button and an intermediate stage in the folding of such metal portions, FIG. 18 shows peripheral and back scoreline formation, with such scorelines being formed immediately prior to final orientation of such multi-layer folds of sheet metal contiguous to the peripheral scoreline, FIG. 19 shows a final minor rivet button shaping and final orientation of the multi-layer folds of metal for shielding residual scoreline metal remaining on the removable disc to be separated from the end closure structure, and FIG. 20 shows the rivet button formed into a rivet securing a tab opener to the disc and final orientation of the multi-layer metal folds for shielding the residual scoreline metal remaining on the container.

The present invention provides a procedure and structure which make high mechanical advantage lever action available throughout a major portion of scoreline severance for removal of a disc for full-opening of an end closure structure.

Endwall closure structure 25, shown in top plan view in FIG. 1, includes chime seam metal 26 around its outer periphery. Integral tab opener 28 is secured to removable disc 30 by rivet 31. The working end 32 of elongated tab opener 28 is positioned contiguously, in contiguous relationship, to a portion of peripheral scoreline 33. In the embodiment shown, the removable disc 30 is defined by circular-configuration peripheral scoreline 33.

Back scoreline portions 34, 35 (FIGS. 1 and 2) extend in transverse relationship to the diametric alignment of the longitudinal axis of opener 28; and, are disposed to establish a fold line radially inboard of the vertical axis of rivet 31. Such fold lines 34, 35 define, at least in part, a chord across a minor portion of the circular peripheral scoreline 33.

The tab opener 28 is non-lanced and is selected to have appropriate longitudinal strength characteristics for the disclosed functions; e.g. sheet metal gage is selected and the tab opener can be reinforced longitudinally (as described in more detail later) enabling it to act as a rigid high-strength lever throughout severance of a major portion of a substantially full panel disc.

In one embodiment, the tab opener presents a solid configuration which is free of any pull pener at or near its handle end 36; such solid configuration discourages prematurely pulling backwardly on the handle. As shown prior to initiation of opening, the handle end is located over a centrally-located panel-profiling indentation 37 to provide access for initiating a lifting action for arcuate movement of the handle end of the tab opener in a direction externally away from the container.

The back scoreline configuration of FIG. 1 is shown more completely in the bottom plan view of FIG. 2, in which the end wall structure is seen as it appears on that side of the end structure which will confront the interior of a can after assembly with a can body. Fold lines 34, 35 are joined by rivet-circumscribing central portion 38, having a configuration shown in greater detail in FIG. 3.

Central portion 38 is disposed about the periphery of a portion of rivet 31 (FIG. 3). In the embodiment shown, central portion 38 is formed from multiple radii so that portion 40 protrudes from the remainder in a radially inward direction. The small radius of portion 40 provides a semi-pointed configuration, directed vertically inwardly, which ruptures readily to vent the container upon initial lifting of the handle end 36 of tab opener 28. Arc portions 41, 42 on each lateral side of the scoreline 38 lead to laterally directed arms 34, 35, respectively. Such laterally directed arms 34, 35 are scored to provide at least for bending of a portion of the sheet metal to form a chord (better seen in later FIGS. 7 and 8) in the circular disc defined by scoreline 33.

The laterally directed arms 34, 35 help to define segment 45 of circular panel 30. Segment 45 is bent inwardly of the container by the opening procedures prior to full panel severance. The bend lines formed by arms 34, 35 terminate before intersection with the peripheral scoreline and are positioned radially inboard of axis 44 of rivet 31. The resulting bend-line chord acts as the fulcrum for the Class 1 lever action of opener 28. The area of the segment 45, which is bent inwardly of a container, is increased by such location of arms 34, 35 over that which would be provided if the bend lines were oriented to pass through the center of rivet 31.

Initial rupturing stages are shown in sequence in FIGS. 4–6 with arrow 46 indicating the direction of arcuate movement of the handle end of opener 28 throughout the entire opening procedure. Initially, the handle end is lifted in a direction away from the exterior of the container.

For nomenclature purposes, note that the peripheral chime metal 26 of FIGS. 1 and 2 constitutes the exposed (upper) surface of chime seam 47 as shown in the cross sectional views of FIGS. 4–6. Also note that panel 30 is countersunk in relation to the longitudinal position of such upper surface of chime seam 47. Rupture of the back scoreline rivet-circumscribing central portion 38 and start of rupture of a minor arc portion of the peripheral scoreline 33 are shown in FIG. 5.

After initial rupture, the arcuate movement of the handle end of opener 28 is continued in the same direction. In the embodiment of FIGS. 1–3, bending along arms 34, 35 provides for folding of a starter segment 45 inwardly of the container. That is, in place of pulling backwardly (as in the prior art) on the tab opener 28 when it is in an upright position, the movement of the handle end of tab opener 28 is continued in the arcuate direction 46. The chord, at least partially defined by arms 34, 35, acts as the pivot line rather than the central axis of rivet 31 in disposing segment 45 inwardly of the container.

Such arcuate movement of the handle end of opener in the direction 46 continues until that surface of tab opener 28, which initially faced upwardly, is moved in an arc approximating 180° into contact with the upper surface of chime seam 47 (FIG. 7). This completes disposition of segment 45 under the remainder of disc 30 as portion 48 of the peripheral scoreline is ruptured. Segment 45 is shown as it appears from the inner surface of an end wall structure in FIG. 8.

The contact between the initially exposed top surface of elongated opener 28 and the chim seam 47 (FIGS. 7 and 9) acts as a fulcrum for continued lever action severance of the peripheral scoreline (such action taking place with the hand of the user being located externally of a vertical projection of the peripheral scoreline). The continuing arcuate movement (arrow 46) of the handle end of opener 28 causes Class I lever action output, at the working end of opener 28 in the direction of arrow 50 (FIG. 10). This action in a vertically oriented outward direction (in relation to a container) on the remainder of the panel causes substantially complete severance of the remainder of the peripheral scoreline around disc 30.

As shown in FIG. 10, the full disc can thus be moved upwardly from its countersunk position by such lever action severing of most, if not al, of the remainder of the scoreline 33 around disc 30. The tab opener remains secured to the removable disc through segment 45 which remains joined to the remainder of the disc 30 by the residual metal along arms 34, 35 and/or metal between the ends of such bend arms and the peripheral scoreline 33. The disc 30, when severed about its periphery, e.g. as shown in FIG. 10, can be readily lifted away from the open container. The lever action which pushes the working end 32 of opener 28 in the direction of arrow 50 is most pronounced in severing scoreline 33 from the ends of the segment 45 toward and immediately beyond the diameter of disc 30 which is perpendicular to the longitudinal axis of the tab opener. Thereafter, as the peripheral scoreline is converging, the force required for removal is diminishing so that lever action assistance requirements are diminishing.

A back scoreline configuration for a preferred embodiment of this aspect of the invention is shown in FIGS. 11 and 12. In this embodiment the area of the starter segment portion of the disc initially folded into the container is decreased in a manner which increases the mechanical advantage available through tab opener lever action over that of the configuratio of FIGS. 1–3.

A more complete view of the back scoreline configuration is available in the bottom plan view of FIG. 11; and the tab opener 51 is seen in FIG. 12. Such back scoreline means include a rivet-circumscribing central portion 52 and angled legs 53, 54; which, in this embodiment have a curvalinear configuration initially extending laterally in relation to a diameter of the panel and then in a generally radial direction toward peripheral scoreline 33 terminating at points 55, 56. Chord 57, shown in broken lines extending between termination points 55, 56, and beyond toward the peripheral scoreline, forms segment 58 (FIG. 12), which is smaller than segment 45 of the earlier-described FIG. 3 embodiment. As a result, the effective length of the opener acting as work-input lever arm is increased during initial rupturing and, also, subsequently due to the increased length of the opener which is disposed radially outwardly of the chime seam (fulcrum). That is, during both phases of such opening procedure the mechanical advantage of the lever is increased.

The back scoreline means of FIG. 11 is scored for severing along central portion 52 and the angled legs 53, 54 to termination points 55, 56. With this configuration the back scoreline turns toward the peripheral scoreline with a major component in the same direction as the longitudinal axis of the elongated opener 51. That this configuration can be used without concern for completely ripping a minor wedge from the removable disc is due to the multi-layer fold teachings, for shielding raw-edge metal, shown and described in relation to later figures. These fold lines prevent segment 58 from being torn completely from the remainder of the disc, thus enabling the increased mechanical advantage of the back scoreline configuration of FIG. 11 to be realized. Note that the action of completing severance of the disc takes place while acting on the handle end of tab opener 51 while it is disposed outside a projection of the scoreline—this provides an added safety feature.

Referring to the non-lanced (longitudinally rigid) tab opener shown in bottom plan view in FIG. 13, peripheral fold-over edge metal, such as 59, around the periphery of tab opener 28 increase its strength longitudinally for lever action purposes; use of ribs such as 60, contiguous to rivet opening 61, add to that longitudinal strength.

A chisel point 62 can be provided at the working end of opener. Increasing the length and longitudinal strength of the tab opener facilitates the opening procedure taught herein.

The rigid, longitudinally reinforced opener 63 of FIG. 14 can be cut from narrow-width continuous lengths of sheet metal. In this embodiment, the working end 64 is provided with a generally matching configuration to that of handle end 65; that is, the convex working end 64 matches the concave handle end 65 so that openers such as 63 can be cut from continuous lengths. The concave configuration at the work input end accommodates manual lifting action and the convex configuration working end provides a narrowed point-like contact to facilitate initial puncture. Longitudinally reinforcing profile ribs 66, 67, can be formed, along with rivet aperture 68 before stamping an opener, such as 63, from a continuous length of metal. Rounded edge metal folds, preformed along parallel side edges in such a continuous length of metal add to the longitudinal strength and can eliminate the need for profiling ribs.

FIGS. 15 through 20 are radial cross-section, partial views for purposes of describing sequential formation of a preferred structure for shielding the raw edge metal remaining after severing of the peripheral scoreline. FIG. 15 shows results of a first forming operation in which the panel 30 is countersunk in relation to chime metal 26. In radial cross section, chuck wall 69 and a series of steps and risers (as seen in cross section) lead to countersunk panel 30. Such steps and risers, generally designated 70, are part of the sheet metal portions for forming a pair of multi-layer metal folds for shielding residual raw edge metal remaining with a disc after severance of the scoreline 33 and also residual raw edge metal remaining with the container.

These metal portions are joined by transition zones between the steps and risers. Step portion 71 leads to riser portion 72 through intermediate curvilinear-configuration zone 73; step portion 74 is connected to riser portion 72 through curvilinear zone 75; step portion 74 leads to riser portion 76 through intermediate zone 77; and riser portion 76 leads to intermediate zone 78 formed with panel 30.

In carrying out the procedures of FIGS. 15–20, the timing of the folding action and the scoring action and, the extent to which multi-layer folding is carried out prior to formatio of the peripheral scoreline 33, are important considerations.

The peripheral scoreline for the removable disc is disposed intermediate the separate multi-layer folds which separately shield residual scoreline metal on the separated disc and on the container end structure. The procedure taught enables access between such multi-layer folds for scoring a single thickness of metal while, at the same time, providing for completing a sheet metal folding action around such circular periphery to move rounded folds of metal into position to shield such residual scoreline metal without premature damage to residual scoreline metal.

In a sequential operation (FIG. 16), an initial rivet button configuration 80, which is dome-shaped in cross section, is formed. Also step portion 74 is oriented horizontally as shown; peripheral scoring will subsequently take place on such horizontally oriented metal portion 74.

Multi-layer folding of metal, scoreline formation, rivet button formation and riveting a tab opener to the disc are coordinated while optimizing the number of work strokes. In addition to the above enumerated advantages of scoring a single layer of metal and avoiding premature damage to residual scoreline metal, the rivet button formation and riveting actions are carried out in the sequence without interfering with the metal folding or scoring operations.

Referring to FIG. 17, metal portions 71, 72 and compound curvature zone 73 will form a multi-layer fold for shielding the raw edge metal remaining with end structure on the container. Metal portion 74 will be the connector between the separate multi-layer metal folds; peripheral scoring to define the removable disc 81 will be carried out on metal portion 74. Metal portions 76, zone 78 and a portion 82 (of the recessed panel adjacent to zone 78) will form the multi-layer folds for providing the shielding for the residual raw edge metal remaining with the severed disc 81.

In FIG. 17, a new, smaller-diameter, greater-depth rivet button 83 is formed and the angled relationship interfolding of the metal portions 76, 82 about zone 78 is increased, as shown.

In the illustrated embodiment, multi-layer folds of metal for shielding both the scoreline residual metal on the disc and remaining with the end structure on the container are provided. Other methods (not necessarily part of the prior art) for protecting the residual scoreline metal remaining with the container, such as profiling of a container side wall have certain disadvantages. For example, the illustrated embodiment does not diminish container contents and provides an increased area for dispensing container contents.

In FIG. 18, the angled relationship of sheet metal portions 71, 72 (about zone 73 for the container multi-layer folds) is increased, as shown, while leaving access for scoring tool 86 to form the peripheral scoreline in metal portion 74. The back scoreline is formed by tool 87.

The multi-layer folds which will remain with the disc are angled as shown in FIG. 17 while leaving access for bucking up tool 88 for peripheral scoring; such access past curvilinear zone 78 facilitates accurate depth scoring. It has been found that the variations in sheet metal thickness, which are acceptable within nominal gage tolerances, do not provide for sufficiently accurate depth scoring on more than one metal layer; therefore, providing access for single layer scoring and having previously established the desired angle orientation of metal fold layers to provide such access are important contributions of the invention.

Note that, notwithstanding near-completion of both separate multi-layer folds, access is provided for the scoring tool on the one surface of single layer metal portion 74 and for back-up tooling on the remaining surface. Also, the final minor orientation of the pair of multi-layer folds contiguous to the peripheral scoreline and riveting the tab opener to the disc do not strain the residual scoreline metal.

Back scoreline means tooling 87 (FIG. 18) is selected to establish desired impressions, e.g. central portion 38 and bend lines as described in relation to the embodiment of FIGS. 1–3.

As shown in FIG. 18, the disc multi-layer folds are oriented with the rounded edge zone 78 extending radially to at least the circular peripheral scoreline so as to be in shielding relationship to raw edge metal on the disc after severance.

During the sequence of FIG. 19, a final minor rivet button shaping, prior to forming the rivet, takes place as shown at 90.

In the final sequence shown at FIG. 20, a tab opener, e.g. 28, is placed over rivet button previously formed at 90 (FIG. 18) prior to forming rivet 31 with tools 92, 94. The Multi-layer folds to remain on the container are oriented, as shown, so that compound curvature zone 73 extends in shielding relation over the raw-edge of metal which will remain when the peripheral scoreline is severed. Metal portions 71, 72 are oriented to provide desired shielding by zone 73 while leaving clearance for removal of disc 81 from the container upon severance of the peripheral scoreline 33.

The approximate values of following tables are representative for a 307 diameter end structure:

| | |
|---|---|
| sheet metal coating | 85#/lb flat rolled steel tinplate or TFS with organic coating |
| nominal thickness | .0095" |
| blank diameter | 4.225" |
| peripheral scoreline "33" dia. | 3.1" |
| residual scoreline metal thickness | .002" |
| residual bend line metal thickness | .005" |
| curvalinear zone "75" (FIG. 19) dia. | 3.18" |
| chuck wall "69" dia. | 3.25" |
| chuck wall height | .18" |
| Vertical height between C/L seam metal 26 and panel 30 | |
| FIG. 14 | .39" |
| FIG. 19 | .21" |
| Rivet head (diameter) | .25" |

The location of the rivet depends on the size and location of the tab opener; typically the chisel point of working end of the tab opener is contiguous to but sufficiently inboard of the peripheral scoreline so that rounded edge 73 does not impede the arcuate movement of the working end of the opener. The spacing from the working end of the tab opener to the aperture for the rivet determines the location for the rivet in the end wall panel; typically the C/L of the rivet would be 1.25" from the center of the end panel in the above example.

| | |
|---|---|
| Tab Opener 28 | |
| sheet metal | flat rolled steel |
| coating | tin plate, TFS or galvanized |
| nominal thickness | .016" to .019" |
| overall length | 1.54" |
| maximum width | 1.1" |
| rivet opening - distance from working end | .30" |
| Tab Opener 51 | |
| sheet metal | flat rolled steel |
| coating | .5#/bb |
| nominal thickness | .017 |
| overall length | 1.36 |
| maximum width | .92 |
| rivet opening - distance from working end | .30 |

The thickness gage for the tab opener can vary with the length and reinforcing provided by edge rolling and metal profiling. The object when working with the embodiment of segment 45 is to proide for from twelve (12) to fifteen (15) pounds of force to be applied to the work input end of the tab opener without permanent damage to the tab opener due to folding or collapsing along its length. With the embodiment of segment 57, such force requirements are decreased by about 60%.

While specific values, materials, and configurations have been shown for purposes of specifically describing embodiments of the invention, other values will be available in the light of the above teachings; therefore, for purposes of determining the scope of the present invention reference should be had to the appended claims.

We claim:

1. Full-open disc-removal convenience-feature sheet metal end-closure structure, comprising a circular-configuration end wall panel circumscribed by unitary chime seam metal for attaching the end wall closure structure to a cylindrical configuration container, such panel being recessed in relation to such chime seam metal, a peripherally located scoreline in such end wall panel defining a removable disc to provide an opening in such end closure structure which facilitates full removal of container contents, an elongated non-lanced tab opener secured by a unitary rivet to such removable disc with the longitudinal axis of such elongated tab opening being oriented diametrically of such end wall panel, such elongated tab opener having a working end and a handle end at its longitudinally opposite ends, with such working end being disposed contiguous to a portion of such peripheral scoreline for initiating rupture thereof, and back scoreline means positioned in such removable disc, such back scoreline means including a central portion partially circumscribing such rivet and located generally inboard in relation to such rivet toward the center of such removable panel, such central portion being scored for initial rupturing and to provide venting of a container while such tab opener is in overlaying relationship to such central portion, an extension arm extending from each side of such central portion in angled relationship to the diametrical orientation of such elongated tab opener, such extension arms terminating prior to contact with such peripherally located scoreline, such central portion of the back scoreline means being ruptured by Class II lever action upon initial movement about such unitary rivet as a fulcrum with the handle end of the tab opener moving away from the end wall panel in an arcuate direction extending externally of such container, such extension arms of the back scoreline means being located to establish a bend-line chord in transverse relationship to such diametrical orientation of the elongated tab opener's longitudinal axis and extending toward such peripherally located scoreline on opposite sides in relation to such longitudinal axis of the tab opener, with the location and positioning of such bend-line chord establishing a minor portion of the removable disc which is folded inwardly of such container as continued arcuate direction movement of such tab opener ruptures a minor portion of the peripherally located scoreline, such minor portion of the peripherally located scoreline being ruptured by Class I lever action of such tab opener about such bend-line chord as a fulcrum, with rupture of the remainder of such peripherally located scoreline beyond such minor portion being carried out after continued arcuate direction movement of the elongated tab opener through about one hunmdred eighty degrees to bring about contacxt of such tab opener with such chime seam metal, such chkme seam metal contact then acting as a fulcrum location for additional lever action severance of the peripherally located scoreline in which such working end of the elongated tab opener acts against an inner surface of such removable disc at a position contiguous to and radially inboard of the original location of such rivet, such additional lever action provided by continued arcuate direction movement of such elongated tab opener about such chime seam metal as a fulcrum comprising Class I lever action which moves such removable panel in a direction externally away from such container to continue rupture of such remainder of the peripherally located scoreline.

2. The structure of claim 1 in which such peripherally located scoreline is of circular configuration in plan view of such end wall closure structure and further including raw edge shielding means for severed residual metal of the peripherally located scoreline metal comprising multi-layer folds of sheet metal peripherally circumscribing portions of such removable disc, such multi-layer sheet metal folds presenting in a plan view of such removable disc a substantially circular configuration in copntiguous relationship to the peripherally located scoreline, with a rounded-edge material portion of such multi-layer metal folds having a circumference substantially equal to that of such peripheral scoreline so as to be in shielding relationship to raw edge metal of such peripheral scoreline after severance thereof, such rounded-edge metal obstructing direct access to such raw edge residual scoreline metal.

3. The structure of claim 2 further including raw edge shielding means for severed residual metal of the peripherally located scoreline remaining with such enclosure structure associated with such container, comprising multi-layer folds of such end wall structure sheet metal located radially outboard of and contiguous to such circular configuration peripheral scoreline, such multi-folds of sheet metal for shielding raw edge metal remaining with such end wall structure presenting, in a plan view of such end wall structure, a substantially circular configuration with a rounded-edge metal portion of such multi-layer folds having a circumference substantially equal to that of such peripheral scoreline and protruding radially inwardly of such end wall structure so as to shield raw edge metal extending about such opened container upon severance of such peripheral scoreline and removal of such circular disc by obstructing direct access to such raw edge residual scoreline metal.

4. The structure of claim 2 in which such multi-layer folds of sheet metal on such removable disc are disposed on the interior surface of such end wall structure in relation to such container.

5. The structure of claim 3 in which such multi-layer folds of end wall sheet metal remaining on such end wall structure are disposed on the exterior surface of such end wall structure in relation to such container.

6. The structure of claim 1 in which the peripherally located scoreline is of circular configuration in plan view of such end wall structure further including raw edge metal shielding means for residual scoreline metal after rupture of such peripheral scoreline, such edge shielding means including a pair of multi-layer folds of sheet metal, one each of such pair of multi-layer folds of sheet metal being located on opposite surfaces of such end wall structure, each of such multi-layer folds of metal being contiguous to such peripheral scoreline and presenting a rounded metal edge portion for shielding the residual raw edge metal about such removable disc and about such end wall structure opening on such container by at least partially obstructing direct access to such residual metal raw edges after opening of such end wall structure.

7. The structure of claim 1 in which such central portion of the back scoreline means which partially circumscribes such rivet includes a portion which is non-concentric with such rivet having a configuration to facilitate rupture, such non-concentric portion extending radially inwardly toward the cneter of such end wall structure along the diametrical orientation of such elongated opener so as to be ruptured upon such initial movement of such working end of the tab opener.

8. The structure of claim 1 in which such tab opener is longitudinally reinforced.

9. The structure of claim 1 in which such tab opener presents a solid confiburation handle end which is free of any finger aperture.

10. A high-strength sheet metal tab opener for use in making a full-panel disc-removal opening in a sheet metal end closure for a container, such tab opener having an elongated configuration which is substantially symmetrically disposed about its central longitudinal axis with a working end and a handle end at its longitudinally opposite ends, with characteristics of such tab opener being selected from the group consisting of sheet metal thickness gage and reinforcing profiling to provide longitudinal rigidity during use of such tab opener as a lever in opening a container, the elongated configuration tab-opener being free of lancing while presenting means disposed toward its working end for securing such tab-opener to an end closure, and further presenting a solid configuration between such securing means and the handle end of the elongated tab opener such handle being free of any finger opening.

11. The structure of claim 10 in which such selected tab opener characteristics include longitudinal reinforcing means comprising a longitudinally-directed rounded edge configuration presented by holding over edge metal along side portions of such elongated tab opener between longitudinal ends thereof.

12. The structure of claim 11 in which such tab opener presents rectilinear side edges in parallel relationship to each other.

13. The structure of claims 10, 11, or 12 in which such sheet metal comprises flat rolled steel having a thickness gage betwen about 0.015" and 0.010", such flat rolled steel having a protective coating.

14. The structure of claim 11 or 12 further including reinforcing profiling formed in such sheet metal intermediate such side edges and extending longitudinally of such opener.

15. The structure of claim 10 in which such working longitudinal end includes a chisel-point configuration to facilitate puncture of scored sheet metal.

16. The structure of claim 12 in which such longitudinal working end has a convex configuration in plan view and such longitudinal handle end has a concave configuration in plan view, such longitudinal end configurations matching so as to permit cutting of such opener from an elongated strip of sheet metal.

17. Method for fabricating an easy-open disc-removal end wall structure for a cylindrical container from flat-rolled sheet metal so as to provide post-opening shielding of residual raw edge metal from a circular-configuration peripheral scoreline defining a full opening for such container comprising providing a circular-configuration flat-rolled sheet metal blank of predetermined diameter, such sheet metal blank being symmetrically disposed about a centrally located axis which is perpendicular to the plane of such blank, forming chim seam metal about the periphery of such sheet metal blank for attaching such end wall structure to a cylindrical container, and axially countersinking an end wall panel of such blank which is located radaially inward of such chime seam metal, to be disposed axially toward the interior of such a container from such chime seam metal with inner and outer surfaces of such end wall panel being substantially planar, such countersinking defining a chuck wall of substantially cylindrical configuration contiguous to and extending from such chime seam metal in such axial direction toward the interior of such a container, and a configuration which is stepped in radial cross section in extending between such chuck wall and the countersunk end wall panel, such stepped configuration including a plurality of unitary metal portions in angled relationship to each other with a compound curvilinear transition zone located at such chuck wall, between each pair of angled metal portions, and at such end wall panel, establishing horizontal orientation for a metal portion located intermediate other angled metal portions of the stepped configuration between such chuck wall and the countersunk end wall pane, such horizontally-oriented metal portion being established for locating a circular scoreline for defining such disc to be removed from such end wall structure with remaining angled metal portions being located radially inboard and radially outboard of such intermediate horizontally oriented portion, orienting angled sheet metal portions located radially on each side of such intermediate horizontal metal portion so as to be in acute-angled, overlaying, prefolded relationship to each other to provide a pair of multi-layer folds of metal, such prefolding orientation of multi-layer folds of metal being carried out to locate one each of such pair of multi-layer folds of metal on opposite surfaces of such end wall panel so as to allow access for a scoring tool on one surface and access for a backing-support tool on the remaining surface of the horizontally-oriented intermediate metal portion, then forming such circular peripheral scoreline to substantially uniform depth in such intermediate metal portion, and then completing disposition of such angularly-folded sheet metal portions in relation to such scoreline to position rounded-edge transition-zone metal forming part of each one of such multi-layer folds of metal contiguous to such scoreline on each such surface of such end wall panel.

18. The method of claim 17 in which a rivet button is formed in such countersunk end wall panel during fabrication of such multi-layer folds of metal and a tab opener is attached to such end wall panel using such rivet button.

19. The method of claim 17 in which prefolding of such angled metal portions to be located radially inboard of the circular scoreline is carried out prior to prefolding such angled metal portions to be located radially outboard of such scoreline.

20. The method of claim 17 in which such multi-layer folds of metal located radially inboard of the circular scoreline are located on the inner surface of such end wall panel, and such scoring is carried out on the outer surface of such intermediate horizontally-oriented sheet metal portion while supporting the inner surface thereof.

* * * * *